United States Patent [19]

Shiki et al.

[11] Patent Number: 4,638,781

[45] Date of Patent: Jan. 27, 1987

[54] FUEL CUT-OFF DEVICE FOR INTERNAL COMBUSTION ENGINE

[75] Inventors: Kazuhiro Shiki, Okazaki; Takao Iura, Toyota, both of Japan

[73] Assignee: Toyota Jidosha Kabushiki Kaisha, Toyota, Japan

[21] Appl. No.: 772,639

[22] Filed: Sep. 5, 1985

[30] Foreign Application Priority Data

Sep. 7, 1984 [JP] Japan ..... 59-187821

[51] Int. Cl.[4] ..... F02D 41/12

[52] U.S. Cl. ..... 123/493; 123/333

[58] Field of Search ..... 123/333, 335, 198 D, 123/198 DB, 493

[56] References Cited

U.S. PATENT DOCUMENTS 4,336,778 6/1982 Howard ..... 123/335 X
4,375,207 3/1983 Sieber et al. ..... 123/333
4,434,759 3/1984 Iezuka et al. ..... 123/333 X

FOREIGN PATENT DOCUMENTS 3319025 11/1984 Fed. Rep. of Germany ..... 123/335
32023 2/1982 Japan .

*Primary Examiner*—Tony M. Argenbright
*Attorney, Agent, or Firm*—Kenyon & Kenyon

[57] ABSTRACT

A fuel cut-off device for an internal combustion engine having a fuel supply means into the engine. The device comprises a fuel cut-off means for cutting the supply of fuel to protect the engine from an abnormal rpm rate when the engine speed exceeds a fuel cut-off reference value at a relatively higher speed range. The device further comprises a racing condition detecting means and a means for determining the fuel cut-off reference value to provide a first value for the loaded condition of the engine and a second lower value for the racing condition of the engine. In the racing condition, the fuel cut-off reference value is further progressively reduced.

8 Claims, 5 Drawing Figures

START
T ← TAU
110
NE > NECUT
112
YES
NO
C CUT ← C CUT-1
116
C CUT = 0
118
NO
YES
C CUT ← A
114
SC < 2 km/hr
120
YES
NO

FUEL CUT-OFF DEVICE FOR INTERNAL COMBUSTION ENGINE

BACKGROUND OF THE INVENTION

1. Field of the Invention

The present invention relates to a fuel cut-off device for an internal combustion engine. The fuel cut-off device is used to protect the engine against the effects of excessive rotational speed (rpm rate). The engine preferably has an electronically controlled fuel injection device and is mounted in an automobile.

2. Description of the Related Art

The use of an electronically controlled fuel injection device to supply fuel to a combustion chamber of an internal combustion engine mounted in an automobile is well known. Such an electronically controlled fuel injection device comprises a fuel injector arranged for each cylinder of the engine at an intake manifold and a control device to control the timing and the length of opening of the fuel injector so as to provide an optimum air-fuel ratio in response to sensed engine operating conditions.

Namely, in this electronically controlled fuel injection device, a basic fuel injection time period is calculated in response to basic operatrng conditions of the engine, based on an engine load generally represented by an intake air volume into the engine or an intake air pressure at the air intake manifold and a rotational speed of the engine, then correction factors based on signals from several sensors arranged on the engine are added to the basic fuel injection time period to provide a final fuel injection time period. Thus, at each revolution of the engine, the fuel injector is opened by the above calculated time period to supply fuel to the combustion chamber.

A fuel cut-off is usually effected by prohibiting the fuel injector from opening at the above opening timing. There are two types of generally established fuel cut-off operations. In one method, a fuel cut-off is carried out during deceleration of the engine at a relatively low engine rotational speed (for example, 1300–900 rpm). This fuel cut-off method improves fuel economy, reduces unburned hydrocarbon components in the exhaust gas, and prevents the catalytic converter from overheating. In another method, the fuel cut-off is carried out at an extremely high engine rotational speed (for example, 6500 rpm), which the engine rarely attains. Therefore, this latter type of fuel cut-off rs rarely effected if the automobile is driven in a normal manner. However, the engine rotational speed may reach such an extreme rate if the automobile is driven in an aggressive manner. It is from this viewpoint that a fuel cut-off is carried out, to protect the engine from such an abnormal rpm rate.

Conventionally, a fuel cut-off operation to protect the engine from excessive rotational rate is effected when the engine rotational speed exceeds a constant reference speed, not only when the engine is running under a load but also when it is running under a "no-load" "racing" condition. Note, the term ∂racing" in this context is generally understood in the art to refer to an engine operating condition in which the engine rotational speed is increased under a "no-load" state. This state often occurs when an accelerator pedal is pushed down while the transmission of the automobile is in neutral position and the automobile is stopped or stopping, and sometimes occurs when the automobile is running with the transmission in neutral position.

With the above type of fuel cut-of control, the driver can feel that the fuel cut-off operation is effected when the engine is operating under a load condition and the automobile is running, because the automobile does not accelerate. However, if the fuel cut-off is carried out in the racing condition and the car is stopping, the driver may not feel the effect of the fuel cut-off operation. Thus the driver may continue to keep the engine in excessive speed, and the fuel supply and the fuel cut-off operations may be repeated many times over a long period of time. This leads to an increase in the vibration and noise of the engine, and the engine is subjected to extreme thermal conditions over a correspondingly long period of time.

Japanese Patent Application No. 58-238220, filed on Dec. 16, 1983, by the same applicant (assignee) as for the present application, relates to a fuel cut-off method intended to protect the engine from such a high rotational speed. The above application discloses the steps of: detecting whether or not the rotational speed of the engine exceeds a fuel cut-off reference value; cutting the supply of fuel if the rotational speed of the engine exceeds the fuel cut-off reference value; and gradually reducing the fuel cut-off reference value to a lower limit determined as being above the normal-use engine rotational speed range, if the fuel cut-off operation is continuously effected. The concept of the above application is similar in principle to that of the present invention, i.e., to protect the engine from an abnormal rpm rate. However, the previous application does not include the concept of changing the fuel cut-off reference speed between the engine load condition and the engine racing condition.

SUMMARY OF THE INVENTION

It is an object of the invention to provide a fuel cut-off device for an internal combustion engine to protect the engine from an excessive rotational speed, which device can reduce the vibration, noise and thermal loading, and thus improve the operating life, of the engine.

In accordance with the present invention, there is provided a fuel cut-off device for an internal combustion engine having a fuel supply means into the engine, the device comprising: a first detecting means for detecting a rotational speed of the engine; a second detecting means for detecting a racing condition of the engine; a means for determining a fuel cut off reference value in response to an output of the second detecting means to provide a first predetermined value at a relatively higher engine revolution range (rpm) than a normal operation range when the engine is in a loaded condition and a second predetermined value below the first predetermined value when the engine is in a racing condition; and a fuel cut-off means for cutting the supply of the fuel into the engine in response to an output of the first detecting means when the rotational speed of the engine is above the fuel cut-off reference value.

BRIEF DESCRIPTION OF THE DRAWINGS

Other features and advantages of the present invention will become apparent from the following description of the preferred embodiment of the present invention, in reference to the attached drawings, in which.

DESCRIPTION OF THE PREFERRED EMBODIMENT

Figure 1:
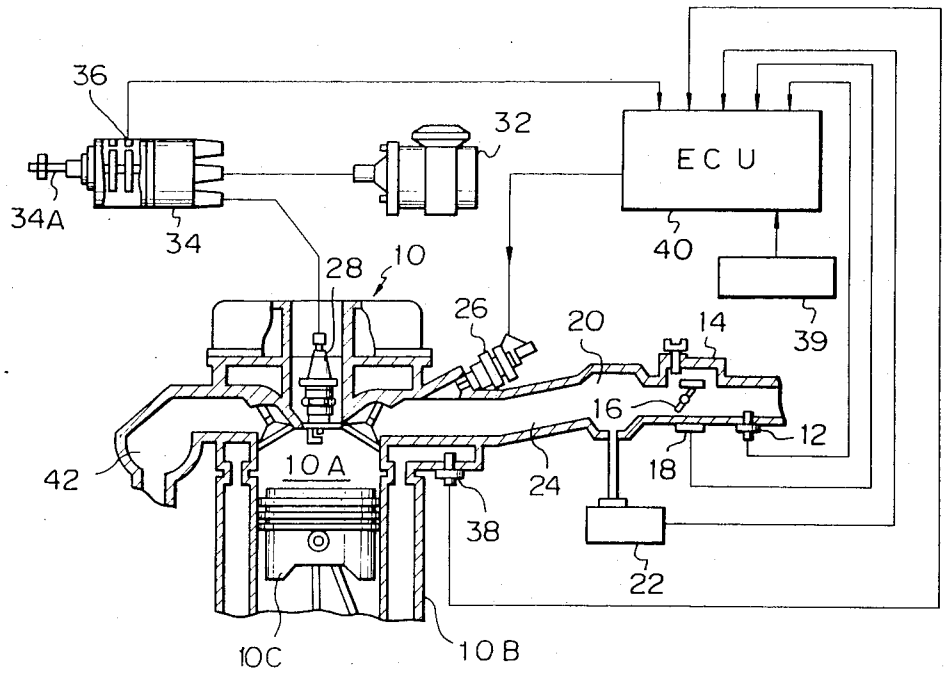
FIG. 1 shows an internal combustion engine according to the present invention.

Referring to FIG. 1, an internal combustion engine 10, according to the present invention, is mounted in an automobile (not shown) and drives the automobile through a transmission (not shown). The engine 10 comprises a cylinder block 10B in which a piston 10C moves reciprocally. A combustion chamber 10A is formed within the cylinder block 10B above the piston 10C. An air intake manifold 24 and an exhaust manifold 42 are connected to the cylinder block 10B, respectively. The air intake manifold 24 is connected to a surge tank 20, which is, connected to a throttle body 14 having a throttle valve 16 movably mounted therein. A fuel injector 26 is mounted on the air intake manifold 24 to supply fuel to the combustion chamber 10A. A spark plug 28 is provided at the top of the combustion chamber 10A. The spark plug 28 is electrically connected to a distributor 34 and an ignition coil 32 to ignite the air-fuel mixture in the combustion chamber 10A.

The fuel injector 26 comprises a solenoid valve controlled by an electric control unit (ECU) 40. The quantity of fuel to be injected is generally proportional to the opening time period of the fuel injector 26, and the supply of fuel into the combustion chamber 10A is cut off when the fuel injector 26 does not open at the required injection timing. This control of the fuel injector 26 is carried out by the electric control unit (ECU) 40, which calculates the opening time period for the fuel injector 26 based on signals input from various sensors. Namely, a pressure sensor 22, mounted on the surge tank 20, detects the intake air pressure representing the intake air volume. A crank angle sensor 36, is mounted on the distributor 34, detects the rotational angle and thus the rotational speed of a distributor rotor shaft 34A, which rotates synchronously with a crankshaft (not shown) of the engine, to detect the engine rotational speed. A first temperature sensor 38 is mounted on the cylinder block 10B to detect the temperature of the engine cooling water, and a second temperature sensor 12 is mounted on the air intake manifold 24 upstream of the throttle body 14 to detect the temperature of the intake air. A throttle position sensor 18 is mounted on the throttle body 14 to detect the position of the throttle valve 16, for example, an idling position and a fully open throttle position, and an automobile speed sensor 39 is mounted, for example, on a not shown rear axle or transmission output shaft of the automobile. In this embodiment, the speed sensor 39 constitutes a racing condition detecting means. Other sensors, such as an oxygen sensor and a temperature sensor in the exhaust gas passage, can be provided.

Figure 2:
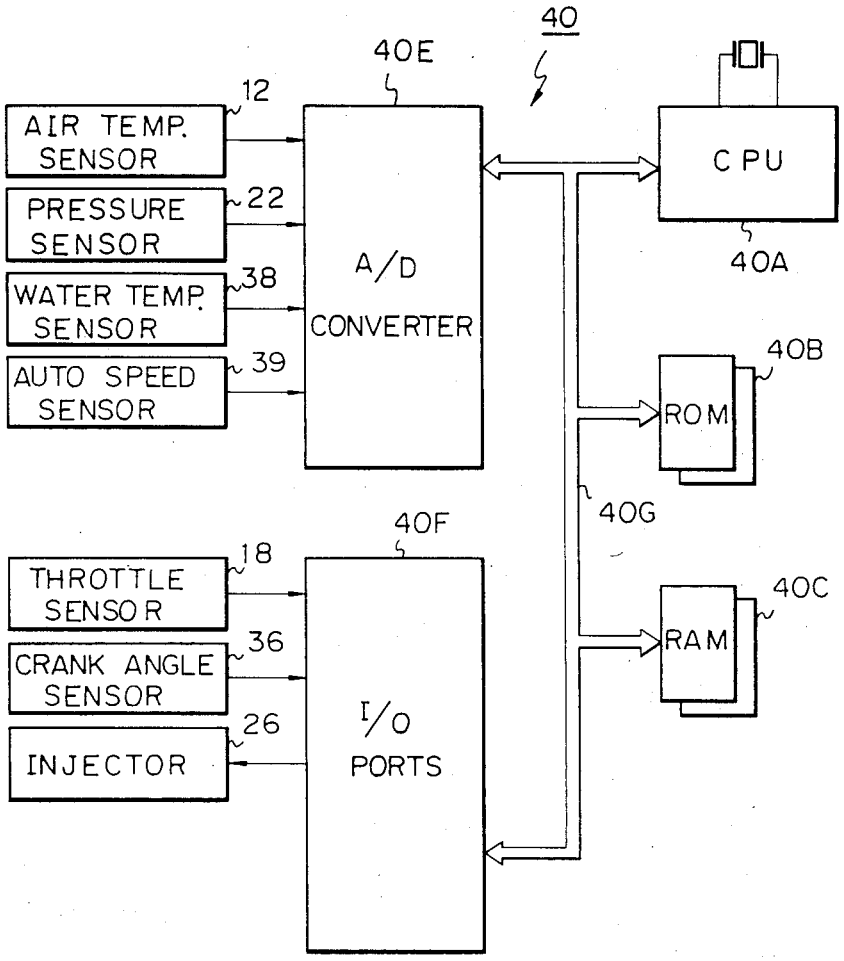
FIG. 2 shows an arrangement of an electric control unit of FIG. 1.

FIG. 2 illustrates a fundamental arrangement of the electric control unit (ECU) 40, which comprises a central processing unit (CPU) 40A constituted by a microprocessor having control and arithmetic functions, a read only memory (ROM) 40B storing a control program and control data, a random access memory (RAM) 40C for temporarily storing data, an A/D (analog/digital) converter 40E having a multiplexing function for receiving analog signals from the first intake air temperature sensor 12, the intake air temperature sensor 22, the second water temperature sensor 38, and the automobile speed sensor 39, and input and output ports (I/0) 40F having a buffer function for receiving digital signals from the throttle position sensor 18 and the crank angle sensor 36 and for outputting a control signal to the fuel injection 26. All of these components are interconnected by a bidirectional bus 40G.

As previously described, the opening time period of the fuel injector 26, which corresponds to the fuel injection quantity, is obtained by calculating the basic fuel injection time period based on the signals from the intake air pressure sensor 22 and the crank angle sensor 36, and then adding correction factors to the basic fuel injection time period. The result is stored in the random access memory (RAM) 40C as TAU at an address T, and the fuel injector 26 is opened at the appropriate injection timing during the time period of TAU. This fuel injection control is well known, and thus details of such control are omitted here.

Figures 3, 3A, 3B:
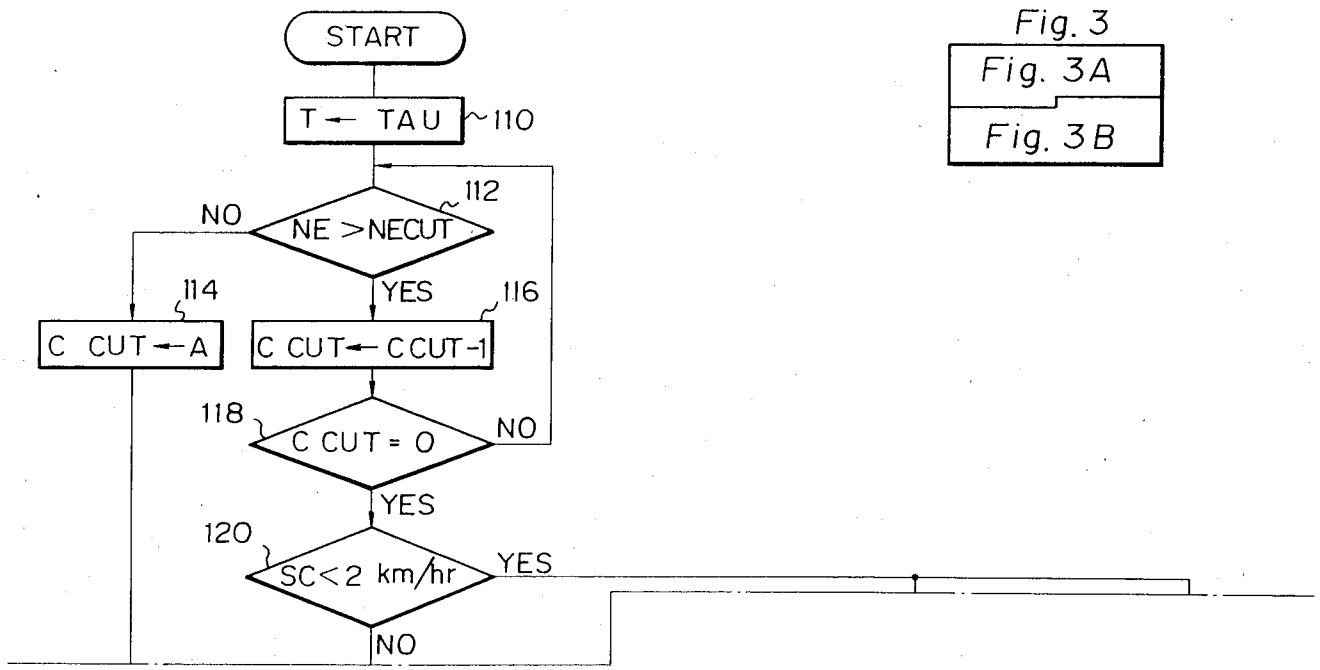
FIGS. 3A and 3B show a flow chart embodying the present invention, together with the components of FIG. 1.
Figure 3B:
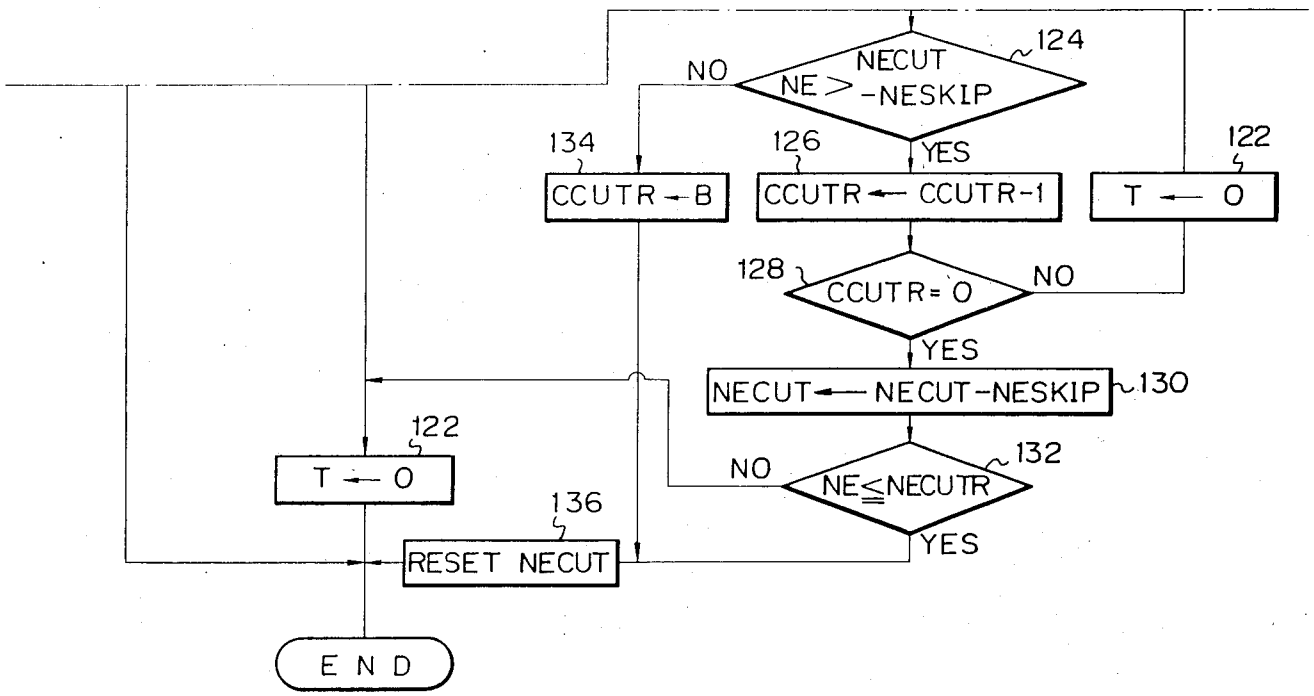

FIG. 3 is a flowchart of the fuel cut-off control to protect the engine from an abnormal rpm rate, according to the present invention, executed by the electric control unit (ECU) 40. This flow starts, for example, at a timing every thirty milliseconds. At step 110, the fuel injection time period TAU, as described above, is stored at the address T of the random access memory (RAM) 40C. At step 112, the rotational speed of the engine NE, as detected by the crank angle sensor 36, is compared with a fuel cut-off reference value NECUT which is stored in the random access memory (RAM) 40C. NECUT is initialized to a predetermined value (for example, 6500 rpm) when the engine is started and may vary to lower values during a racing condition. If the engine rotational speed NE is lower than the fuel cut-off reference value NECUT, the program goes to step 114, at which a predetermined value A is stored in a memory of a first counter CCUT, preparing for the next possible fuel cut-off. In this flow, the program ends at step 114, thereby the fuel injection time period memory T keeps the calculated value TAU by which the fuel is injected at the appropriate injection timing.

If the engine rotational speed NE is greater than the fuel cut-off reference value NECUT, the program passes through several steps to step 122 to effect the fuel cut-off by inputting zero to the fuel injection time period memory T in place of TAU. The steps between steps 112 and 122 are as follows. At step 116, the first counter CCUT is decreased from the value A. At step 118, it is judged whether the counter CCUT is zero. If NO, the program ends at step 118 and starts again from step 112 at the next cycle. This means that the fuel cut-off is initiated when the engine rotational speed NE continues to exceed the fuel cut-off reference value NECUT through several (A) cycles, to avoid a short period of overshoot by the signals from the engine speed sensor.

At step 120, a racing condition is determined. For this purpose, the speed of the automobile, as detected by the sensor 39, is compared with a predetermined relatively low value (2 km/hr) close to zero. It will be obvious to a person skilled in the art that the automobile can be said to be running if the automobile speed is above this value and to be stopped or stopping if the automobile speed is below that value. It will be appreciated that, according to the present invention, the racing condition can be detected both when the engine rotational speed is extremely high (step 112) and when the automobile is stopped or stopping (step 120).

If the automobile is running (NO at step 120), the fuel cut-off is effected at step 122. If YES at step 120, namely, if the engine is in the racing condition, the program goes to step 124, and the engine rotational speed NE is compared with a second fuel cut-off reference value (NECUT-NESKIP). When the program first passes through step 124, the judgement at step 124 must be YES, since the program has passed through step 112. The program then goes to steps 126 and 128. At step 126, a second counter CCUTR is decreased and at step 128 it is determined if the second counter CCUTR is zero, as in steps 116 and 118. The program then goes to step 122 to effect the fuel cut-off. During this cycle, the fuel cut-off is initiated when the engine rotational speed NE is determined to be higher than the first predetermined fuel cut-off reference value NECUT after passing through steps 112 to 120. This same fuel cut-off reference value NECUT also initiates a fuel cut-off when the automobile is running. The next cycle, after the program has passed through steps 126, 128, and 122, starts from step 124. Note that the engine rotational speed NE is not compared with the first value NECUT (step 116) at the second cycle during the racing condition but is compared with the second value (NECUT −NESKIP), which is apparently lower than the first value. NESKIP can be appropriately determined for specific engine designs and is typically, for example, 500 to 1,000 rpm.

Steps 124, 126, 128, and 122 will continue to repeat the cycle until the second counter CCUTR becomes zero, if the driver continues to depress the accelerator pedal without being aware of the abnormal rpm rate of the engine. In this case, the engine rotational speed NE will decrease to the second reference value (NECUT −NESKIP). When the driver releases the accelerator pedal, the engine rotational speed decreases to a value below the second reference value (NECUT −NESKIP). Then the judgement at step 124 becomes NO and the program goes to step 134, similar to step 114, to store a predetermined value B in a memory of the second counter CCUTR. The program then goes to step 136 to reset NECUT to the first value. During this flow, the program does not pass through step 122, and thus the fuel cut-off operation is terminated.

As described above, the value A of the first counter CCUT is relatively small, but the value B of the second counter CCUTR is considerably large, for example, a period of ten seconds will elapse from the time that the program first goes to step 124 to the time that the second counter CCUTR becomes zero at step 128. Therefore, the fuel cut-off state is maintained for ten seconds at the second reference value (NECUT −NESKIP).

If the second counter CCUTR becomes zero (YES at step 128), NECUT is renewed to a value (NECUT −NESKIP) at step 130. The engine rotational speed NE is then compared with a predetermined fuel cut-off reference lower limit NECUTR at step 132. If the engine rotational speed NE is above the lower limit NECUTR (NO at step 132), the fuel cut-off state is continued by passing through step 122. Then the next cycle starts from step 110. Note that the value of NECUT at step 112 is changed from the above first predetermined value to the lower second value as defined by step 132 at the previous cycle, and thus the (NECUT −NESKIP) at step 124 is changed from the second predetermined value to a third value.

Figure 4:
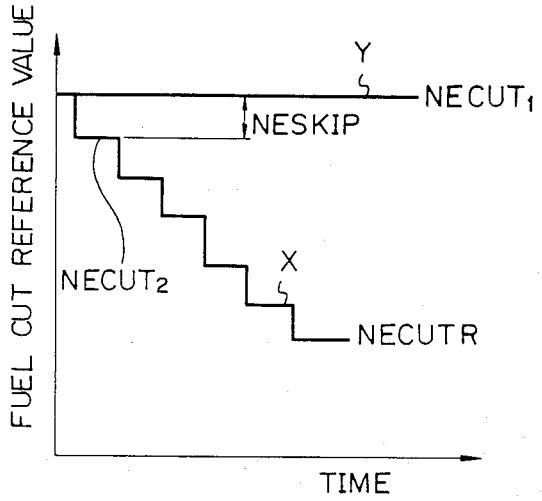
FIG. 4 shows a fuel cut reference value determined according to the present invention.

This change in the fuel cut-off reference value is exemplified in FIG. 4, in which a line Y shows the fuel cut-off reference value when the engine is in a load condition, namely, when the program passes straight through steps 112, 116, 118, 120, and 122 in FIG. 3. The line X shows the fuel cut-off reference value when the engine in the racing condition, namely, when the program passes through steps 120 and 124. NECUT1 is the above first value and NECUT2 is the second value (NECUT1 −NESKIP). If the engine rotational speed NE continues to exceed the second reference value (step 128), the third reference value is determined by (NECUT3=NECUT2 −NESKIP) at step 130. The fuel cut-off reference value is progressively decreased, step by step until the engine rotational speed NE becomes lower than the lower limit NECUTR (step 132). When the engine rotational speed NE becomes lower than the lower limit NECUTR (step 132), and when the engine rotational speed NE becomes lower than the fuel cut-off reference value (step 124), the program does not pass through step 122, which allows the fuel cut-off, but passes through step 136, which resets NETCUT to the first initial value (NECUT1). Therefore, the fuel cut-off is always initiated at that value.

According to the present invention, it is possible to protect the engine from an abnormal rpm rate, especially when the engine is in the racing condition wherein the engine rotational speed is easily increased.

The fuel cut-off is rarely initiated, since it is needed only at a relatively high engine rotational speed. However, once a fuel cut-off is initiated, the engine rotational speed, during the racing condition, is decreased to a lower value even if the driver continues to depress the accelerator pedal. This not only protects the engine but also cuts fuel consumption.

Although the present invention is described herein with reference to only one embodiment thereof, various modifications can be made without departing from the spirit and scope of the present invention. For example, the engine can be fitted with a carburetor with a fuel cut-off device in place of the fuel injection system, and other sensors can be used, for example, an air flow meter in place of the intake air pressure sensor. It is also possible to use a sensor for sensing a neutral position of the transmission to detect the racing condition.

We claim:

1. A fuel cut-off device for an internal combustion engine having a fuel supply means into the engine, said device comprising:

a first detecting means for detecting the rotational speed of the engine;

a second detecting means for detecting a racing condition of the engine;

a means for determining a fuel cut-off reference value in response to an output of said second detecting means to provide a first predetermined value at a relatively higher engine revolution range than a normal operation range when the engine is in a loaded condition and a second predetermined value below said first predetermined value when the engine is in a racing condition; and a fuel cut-off means for cutting the supply of the fuel into the engine in response to an output of said first detecting means when the rotational speed of the engine is above said fuel cut reference value.

2. A device according to claim 1, wherein said fuel supply means comprises a fuel injector.

3. A device according to claim 2, wherein said means for determining a fuel cut reference value provides further predetermined values progressively reduced from said second predetermined value.

4. A device according to claim 3, wherein each interval between two successive said further values is equal to that between said first and second values.

5. A device according to claim 3, wherein said second and further values are reduced progressively when the rotational speed of the engine continues to exceed said reference value during a predetermined time period.

6. A device according to claim 1, wherein said engine is mounted in an automobile, and said second detecting means comprises a speed sensor detecting the running speed of the automobile and means for judging if the automobile speed is lower than a predetermined value.

7. A device according to claim 1, wherein said engine is mounted in an automobile having a transmission, and said second detecting means comprises a sensor detecting a neutral position of the transmission.

8. A device according to claim 1, further comprising means for initiating the fuel cut-off in response to an output of said first detecting means when the engine is in both a loaded condition and a racing condition when the rotational speed of the engine becomes higher than said first predetermined value.

* * * * *

UNITED STATES PATENT AND TRADEMARK OFFICE

CERTIFICATE OF CORRECTION

PATENT NO. : 4,638,781

DATED : 27 January 1987

INVENTOR(S) : K. SHIKI et al.

It is certified that error appears in the above-identified patent and that said Letters Patent is hereby corrected as shown below:

Col. 1, line 26: change "operatrng" to --operating--.
Col. 1, line 62: change "load" "racing" to --load" or "racing"--.
Col. 1, line 62: change "aracing" to --"racing"--.
Col. 2, line 3: change "cut-of" to --cut-off--.
Col. 2, line 43: change "life, of" to --life of--.
Col. 3, line 21: delete comma after "is".
Col. 3, line 41: after "sensor 36," delete "is".
Col. 6, line 22: change "NETCUT" to --NECUT--.

Signed and Sealed this

Twentieth Day of October, 1987

*Attest:*

DONALD J. QUIGG

*Attesting Officer*

*Commissioner of Patents and Trademarks*